US009289771B2

(12) United States Patent
Faure

(10) Patent No.: US 9,289,771 B2
(45) Date of Patent: Mar. 22, 2016

(54) IMPACT MILL HAVING A ROTOR-POSITIONING DEVICE

(75) Inventor: Thierry Faure, Saint Georges de Reneins (FR)

(73) Assignee: METSO MINERALS (FRANCE) S.A., Macon (FR)

( * ) Notice: Subject to any disclaimer, the term of this patent is extended or adjusted under 35 U.S.C. 154(b) by 447 days.

(21) Appl. No.: 13/977,243

(22) PCT Filed: Jan. 24, 2012

(86) PCT No.: PCT/FR2012/050148

§ 371 (c)(1),
(2), (4) Date: Jun. 28, 2013

(87) PCT Pub. No.: WO2012/104521

PCT Pub. Date: Aug. 9, 2012

(65) Prior Publication Data

US 2013/0284839 A1 Oct. 31, 2013

(30) Foreign Application Priority Data

Jan. 31, 2011 (FR) ..... 1150701 A

(51) Int. Cl.

| | |
|---|---|
| ***B02C 13/26*** | (2006.01) |
| ***B02C 13/09*** | (2006.01) |
| ***B02C 25/00*** | (2006.01) |
| ***B02C 13/30*** | (2006.01) |

(52) U.S. Cl.

CPC ..... *B02C 13/095* (2013.01); *B02C 13/26* (2013.01); *B02C 13/30* (2013.01); *B02C 25/00* (2013.01)

(58) Field of Classification Search

CPC ..... B02C 13/095; B02C 13/30; B02C 13/26; B02C 25/00

USPC ..... 241/189.1, 192, 286

See application file for complete search history.

(56) References Cited

U.S. PATENT DOCUMENTS

| | | | |
|---|---|---|---|
| 4,084,752 | A | 4/1978 | Hagiwara et al. |
| 6,953,168 | B2 | 10/2005 | Delille |

FOREIGN PATENT DOCUMENTS

| | | |
|---|---|---|
| AT | 412 451 | 3/2005 |
| FR | 2 334 417 | 7/1977 |
| FR | 2 837 407 | 9/2003 |
| FR | 2 893 863 | 6/2007 |

OTHER PUBLICATIONS

International Search Report dated May 21, 2012, corresponding to PCT/FR2012/050148.

*Primary Examiner* — Mark Rosenbaum
(74) *Attorney, Agent, or Firm* — Sofer & Haroun, LLP

(57) ABSTRACT

The mill includes a milling chamber (1) containing a rotor (2) provided with hammers (4), and at least one impact screen mounted pivotably with the aid of an adjusting jack in order to move the bottom end of the screen toward or away from the rotor so as to define, between the bottom end of the screen and the free end of the hammers, a spacing which determines a given particle size. The mill includes a device for positioning the rotor that includes indexing elements for positioning the end of one of the hammers as close as possible to the screen for adjusting the spacing. It includes a geared motor driving a pinion capable of engaging with a toothed wheel fixed in rotation to the rotor so as to rotate it from a rest state until one of the hammers is as close as possible to the screen.

16 Claims, 2 Drawing Sheets

IMPACT MILL HAVING A ROTOR-POSITIONING DEVICE

The present invention relates to impact mills with a device for positioning the rotor.

Impact mills are generally intended to be installed in quarries or mines for the dimensional reduction of granules or minerals. They comprise a milling chamber containing a rotor which is provided with hammers uniformly arranged on its periphery, and at least one impact screen which, by way of its top end, is mounted pivotably on an articulation connected to the frame of the mill. The impact screen can pivot with the aid of an adjusting jack in order to move the bottom end of the screen toward or away from the rotor so as to define, between the bottom end of the screen and the free end of one of the hammers, a spacing R (see FIG. 1) which determines a given particle size.

In an impact mill, the granules are introduced through a feed opening and are then struck by the hammers secured to the rotor and flung against the impact screen or screens to have their dimensions reduced. Once introduced, the granules are subjected to this process a number of times until they reach the dimension of the adjustment spacing R between the bottom end of the last impact screen and the end of the hammers. Once this dimension has been reached, the reduced granules pass between the hammers and the screen and are evacuated toward the outlet.

The spacing R between the end of the hammers and the edge of the last impact screen, the one which is closest to the rotor, is modified by the wear of the hammers and must therefore be readjusted periodically in order to maintain a uniform particle size. It must also be preregulated before each milling process so as to be adjusted to the outlet particle size desired.

In conventional impact mills, this adjustment is carried out manually by the operator who must first of all, with the device stopped, turn the rotor until it has the end of one of the hammers as close as possible to the bottom end of the last impact screen, and then carry out a manual measurement of the distance between this end of the hammer and that of the screen. He can then either carry out a manual adjustment by means of screws and nuts or act on the hydraulic unit controlling the extension of the jack for positioning the screen until the desired distance is obtained.

In order to facilitate the adjustment of the spacing R between the end of the hammers and the edge of the last impact screen, patent FR2837407 of the applicant proposes means for adjusting the spacing R without direct manual intervention of the operator by indexing the position of the rotor for the adjustment.

According to this patent, the impact mill is provided with a device for positioning the rotor that comprises an indexing part in the form of a prism, which is coaxial and fixed in rotation with the rotor and has a number of projecting edges equal to the number of hammers. This indexing part can bear against an indexing plate mounted at the end of an indexing jack rod so as to cause a rotation of the rotor as far as a position in which the end of the hammer corresponding to the edge is in the position in which it is as close as possible to the impact screen.

Next, the screen is pivoted by means of the adjusting jack until coming into contact with the end of the hammer so as to define the origin of adjustment of the spacing R between these two elements, and thereafter to adjust the spacing for the desired particle size.

Even if the mill according to patent FR2837407 is generally satisfactory when it is a question of adjusting the spacing R between the end of the hammers mounted on the rotor and the last impact screen, it is desirable to provide a device for positioning the rotor that is more flexible and can be easily adapted to a rotor bearing a different number of hammers without being dependent on the shape of the indexing part of FR2837407, which in this case must be replaced by another part adapted to the new number of hammers, and this positioning device must additionally be able to be used to mechanically turn the shaft of the rotor so as to place the hammer to be changed in the desired position in an operation for changing worn hammers, independently of the number of hammers borne by the rotor.

This last operation is particularly tricky since, in order to change a hammer, the rotor will have to be turned such that the hammer to be changed is directed upward, substantially in a vertical position, to be either exited from the top, or slid on the side, after the shaft of the rotor has been blocked in rotation in this position. This operation becomes particularly difficult when the hammer to be changed is not in the desired substantially vertical position when the end of one of the other hammers is situated facing the bottom end of the last impact screen. That is, inter alia, the case when the number of hammers is 5, 6 or 7.

In this case, the operator is obliged to act manually in order to turn the rotor, but this manipulation involves risks. Specifically, in particular for mills of large size having a rotor shaft with a high degree of inertia, this manual rotation requires considerable efforts on the part of the operator.

The aim of the invention is to overcome the disadvantages of the known mills by means of the features of the mill according to the invention.

The subject matter of the invention is an impact mill comprising a frame defining a milling chamber containing a rotor provided with hammers uniformly arranged on its periphery, and at least one impact screen which, by way of its top end, is mounted pivotably on an articulation connected to the frame of the mill, so as to be able to pivot with the aid of a respective adjusting jack in order to move the bottom end of the impact screen toward or away from the rotor so as to define, between the bottom end of the impact screen and the free end of one of the hammers, a spacing which determines a given particle size, the mill additionally comprising a device for positioning the rotor that comprises indexing means for positioning the end of one of the hammers in a position in which it is as close as possible to the impact screen for the purpose of adjusting said spacing, wherein said positioning device comprises a geared motor driving a pinion capable of engaging with a toothed wheel arranged at one of the ends of the shaft of the rotor and fixed in rotation to the latter in order to rotate the rotor from a rest state to said position in which one of the hammers is as close as possible to said impact screen.

According to other features of the invention:

- the geared motor is mounted so that it can be moved translationally between a first position in which said pinion is freed from engagement with said toothed wheel and a second position in which said pinion is engaged with said toothed wheel;
- the geared motor is moved translationally with the aid of a jack;
- a stop is provided to stop the translational movement of the geared motor when said pinion engages with said toothed wheel;
- end-of-travel detectors are arranged so as to detect the end positions of the translational movement of the geared motor;
- said detectors are end-of-travel switches, or inductive sensors;

the geared motor is fixed on a plate which can be moved along a slideway;

said slideway comprises guide rods;

said indexing means comprise locating members arranged at one of the ends of the shaft of the rotor and detected by a fixed sensor, the number of said locating members being equal to the number of hammers;

said sensor is an induction sensor which is sensitive to the locating members; and the indexing means comprise a second fixed sensor offset angularly with respect to the first sensor in order to stop the rotation of the rotor when a hammer is directed substantially vertically upward.

Other features and advantages of the invention will become apparent from the description which will follow of a nonlimiting embodiment of the invention, with reference to the appended figures, in which.

In the figures, the identical or equivalent elements will bear the same reference signs.

Figure 1:
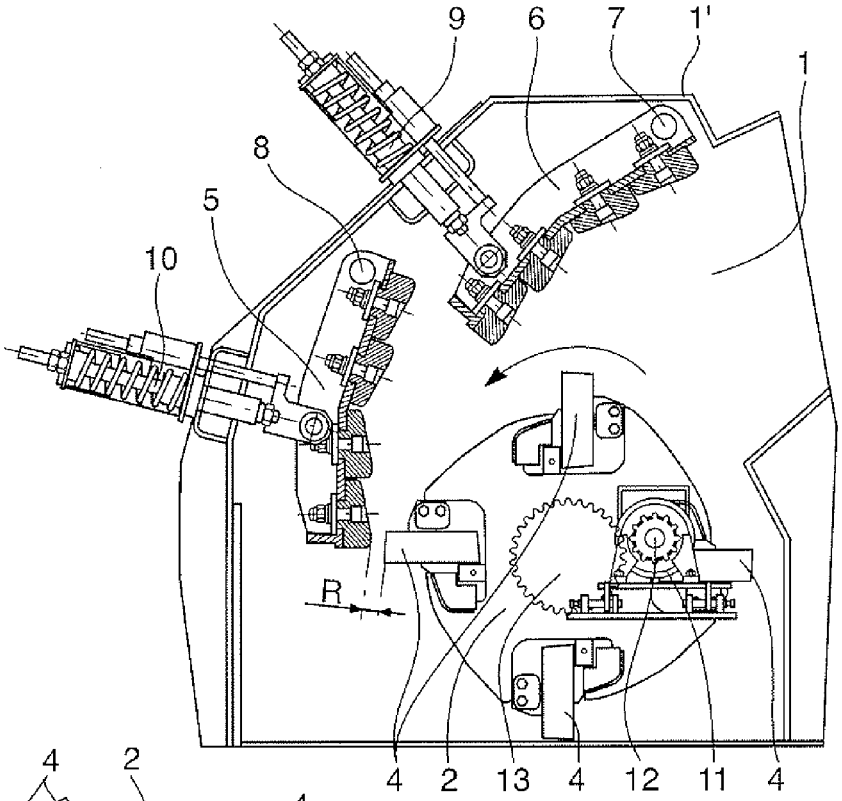
FIG. 1 is a lateral sectional view of a mill according to the invention provided with a rotor having four hammers.

The impact mill represented in section in FIG. 1 comprises a frame 1' defining a milling chamber 1 in which a rotor 2 is mounted fixedly to a rotary shaft 3 driven by a motor (not illustrated). In the example illustrated, the rotor 2 turns in the direction indicated by an arrow in FIG. 1. It is provided with hammers 4 uniformly distributed on its periphery. In the example represented in FIG. 1, the rotor bears four hammers 4, one of which is hidden behind a mechanism which will be described in detail further on.

Two impact screens 5 and 6 are arranged in the milling chamber 1. The impact screens 5 and 6 are, at their respective top end, mounted pivotably on an articulation defined by a respective pivot 7, 8 so as to be able to pivot about the latter by means of to adjusting jacks 9 and 10, respectively, in order to move their free ends toward or away from the rotor 2.

The particle size to be obtained for the material to be milled is adjusted by moving the bottom end of the bottommost last screen 5, according to the case, toward or away from the periphery of the rotor in order to obtain a spacing R by means of which the granules can pass after having reached the adjustment dimension determined by this spacing.

The process of adjusting the particle size takes place in the following way.

With the machine being at a stop, it is necessary to turn the rotor until the end of any hammer 4 is situated facing the bottom end of the bottommost last screen 5 or of the chosen screen, in an adjustment position.

In FR2837407, a device for positioning the rotor is provided by means of which the rotor is slowly turned toward this adjustment position so as to be stopped therein by means of an indexing device. The operator then actuates the adjusting jack 10 in order to move the bottom end of the bottommost impact screen 5 toward the free end of the facing hammer until they come into contact. He has thus determined the origin or the point 0 of the measurement of the spacing R. He then actuates the adjusting jack 10 in the opposite direction until his instrument for measuring the movement of the jack indicates to him the value corresponding to the desired spacing R, that is to say to the given particle size.

Likewise in the mill according to the invention, a device for positioning the rotor 2 is associated with the impact mill. It comprises indexing means which will be described in more detail further on. These means make it possible to position the end of one of the hammers in a position as close as possible to the impact screen for the purpose of adjusting said spacing.

According to an essential feature of the invention, this positioning device comprises a geared motor 11 which is preferably a hydraulic geared motor. The output shaft (not shown) of this geared motor 11 drives a pinion 12 capable of engaging with a toothed ring or wheel 13 arranged at one of the ends of the rotor 2 and fixed in rotation therewith. Preferably, the pinion 12 is fixed directly on the output shaft of the geared motor 11.

The geared motor 11 can be moved translationally between a first position in which the pinion 12 is freed from engagement with the toothed wheel 13 and a second position in engagement therewith.

Figure 2:
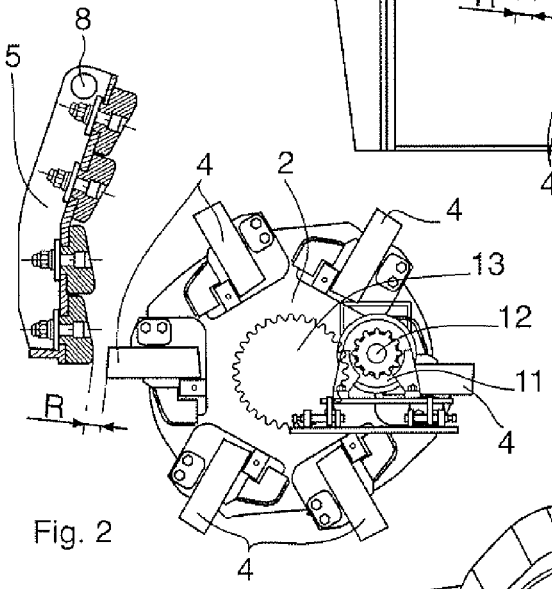
FIG. 2 is a lateral sectional view of a mill according to the invention provided with a rotor having six hammers.
Figure 3:
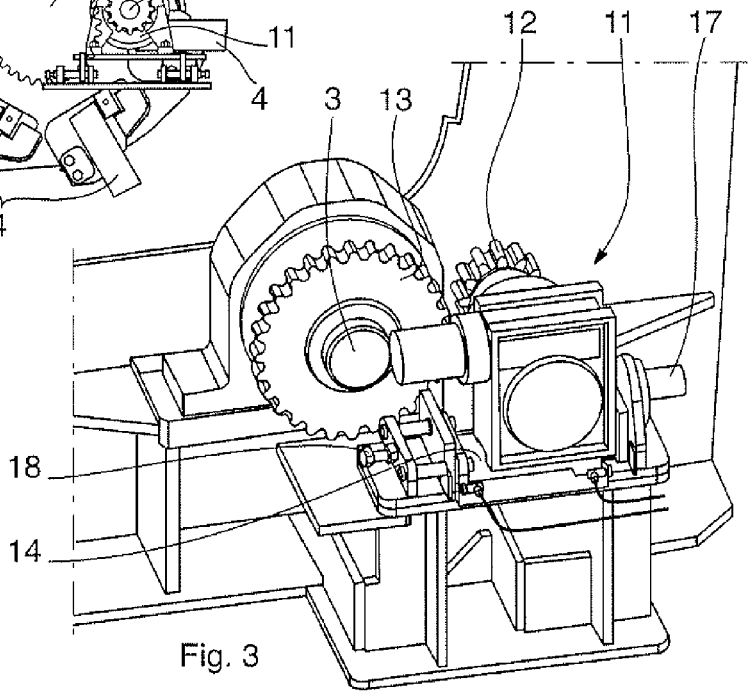
FIG. 3 is a partial perspective view illustrating the device for positioning and indexing the rotor in the nonactuated position thereof.

The first position is illustrated in FIGS. 1 to 3 and corresponds to a deactivated position of the geared motor 11 making it possible for the rotor to be rotated by its main drive motor (not shown) for the normal operation of the mill.

Figure 4:
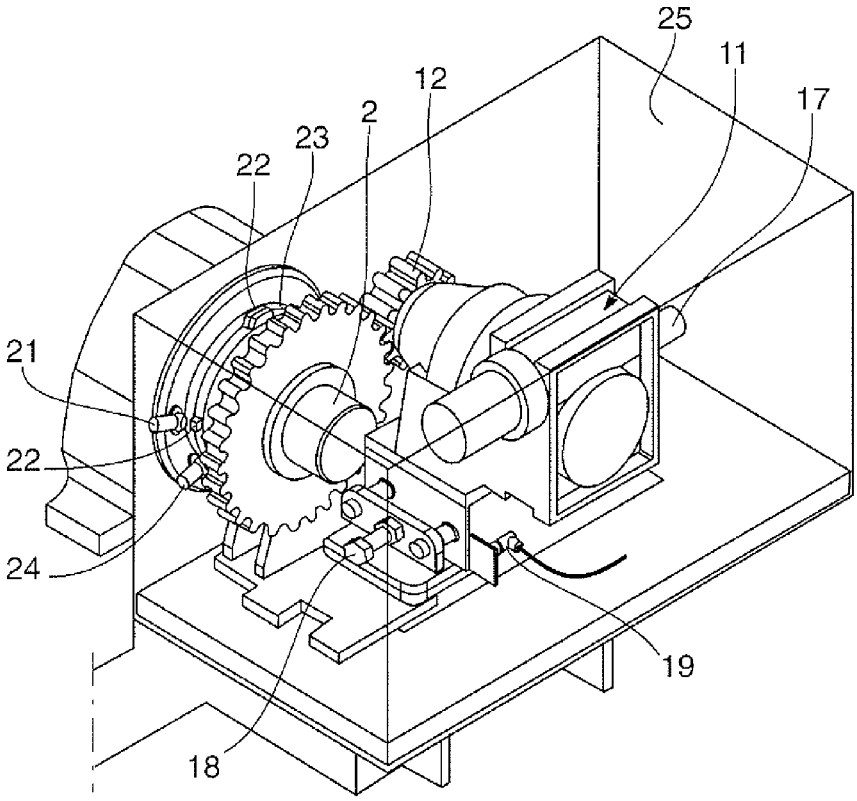
FIG. 4 is a partial perspective view illustrating the device for positioning and indexing the rotor in the actuated position thereof.

The second position is illustrated in FIG. 4 and corresponds to an activated position of the geared motor 11 allowing the rotation at reduced speed in order to carry out the adjustment of the spacing R between the bottom end of the impact screen 5 and the free end of one of the hammers or in order to change the hammers 4.

For its translational movement, the geared motor 11 is fixed on a plate 14 which is itself mounted in a translationally movable manner on a slideway which, in the example illustrated, comprises guide rods 15 extending in guide tubes 16.

According to another feature of the invention, the geared motor 11 is moved translationally with the aid of a control jack 17 which is preferably a hydraulic jack.

An adjustable stop 18 with a stop nut and screw is provided to adjust the translational travel of the geared motor 11 and the meshing of the pinion 12 with the toothed wheel 13.

Furthermore, end-of-travel detectors 19, 20 are advantageously arranged so as to detect the end positions of the translational movement of the geared motor 11 so as to stop the deployment or the retraction of the rod of the jack 17 when these end positions are reached. The position in which the pinion 12 is engaged with the toothed wheel 13 is maintained by virtue of the fact that, during this time, the hydraulic pressure is still exerted.

Moreover, it is advantageous to turn the pinion 12 when it is in the process of meshing with the toothed wheel 13 so that there is no tangency point at the moment of meshing between the pinion and the toothed wheel.

The pinion 12 can thus engage with the toothed wheel 13 so as to rotate the rotor 2 from a rest state thereof as far as the position in which one of the hammers 4 is as close as possible to the bottom end of the bottommost impact screen 5.

In order to stop the rotation of the rotor 2 precisely in this position of maximum closeness, the indexing means according to the invention comprise a fixed sensor 21 fixed in the vicinity of one end of the shaft 3 of the rotor and able to detect the passage of locating members 22 uniformly spaced on a ring 23 which is concentric to the shaft 3 of the rotor 2 and mounted fixedly in rotation therewith. The number of locating members 22 corresponds to the number of hammers 4.

The sensor 21 is preferably an induction sensor sensitive to the material of the locating members 22. The sensor 21 is connected to control means of the geared motor 11 so as to stop its rotation each time a locating member 22 is detected by the sensor 21.

The spacing R between the bottom end of the bottommost screen 5 and the free end of the hammer 4 which is then situated facing it can then be adjusted in the manner described above.

The positioning device according to the invention is also intended to be used to position the motor 2 to change the hammers 4 such that one of the hammers 4 is always directed substantially vertically upward so as then to be removed from the top or from the side. In the case where the rotor 2 bears four hammers 4, as is illustrated in FIG. 1, the angular distance between the hammers is 90°, with the result that one of the hammers will then automatically be directed substantially vertically upward when the preceding hammer is arranged substantially horizontally with its free end facing the bottom end of the screen 5.

It is a different situation if the hammers number 5, 6 or 7. An example of a rotor 2 bearing 6 hammers 4 is shown in FIG. 2. In this case, the angular distance between the hammers is 60°. In order to position one of the hammers so that it is directed substantially vertically upward so that it can be exchanged for a new one, a second fixed sensor 24 is fixed below the first sensor 21 and offset therefrom by 30° such that when a hammer comes to a stop facing the second sensor 24, one of the hammers will be directed substantially vertically upward.

Of course, the second sensor 24 can equally well be arranged above the first sensor 21 and offset by 30° therefrom so as to define an angular distance of 60° with respect to the following hammer which will then be directed substantially vertically upward.

Instead of using a second sensor, it would also be possible to use means for detecting the angular rotation of the shaft 3 of the rotor 2 starting from the position in which a hammer comes to a stop facing the first sensor 21 and to turn the shaft by a desired value so that another hammer is directed substantially vertically upward.

Figure 5:
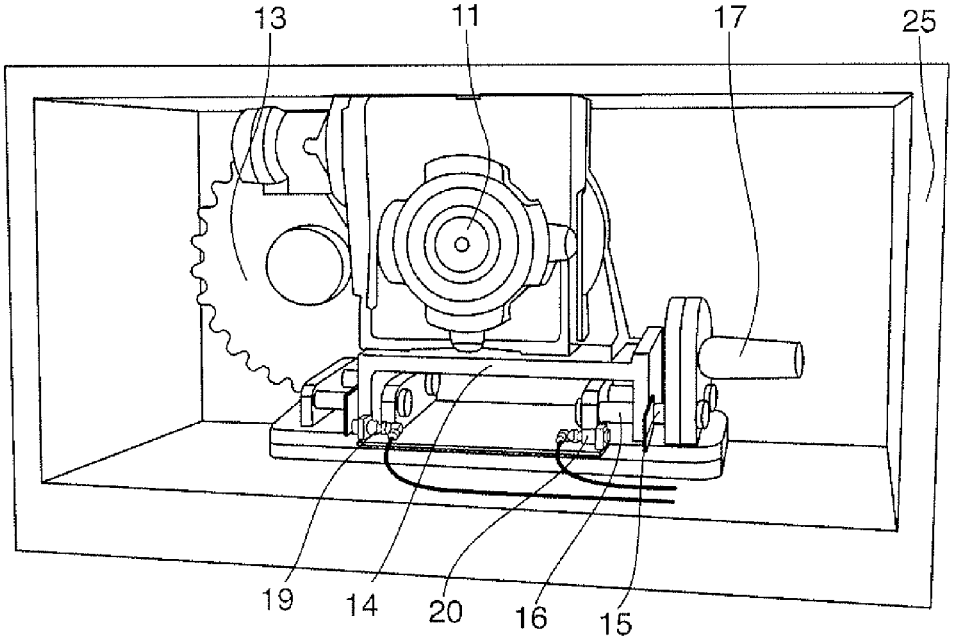
FIG. 5 is a lateral view illustrating in more detail the device for positioning and indexing the rotor comprising a geared motor mounted on a translationally movable plate.

The whole assembly comprising the positioning device with the geared motor 11 and the hydraulic jack which controls its translational movement can advantageously be arranged in a protective housing 25, as is schematically illustrated in FIGS. 4 and 5.

A programmable controller or any other similar system can moreover be used to automatically carry out all the adjustment sequences after having input the adjustment of the spacing R to the value desired by the operator.

Of course, the invention is not limited to the examples illustrated and described, but a person skilled in the art can envision variants without thereby leaving the scope of the invention. Thus, the impact mill according to the invention can comprise a third impact screen and, if it is desired to calibrate a second defined spacing between its bottom end and the ends of the hammers, all that is required is to add a sensor in order to be able to proceed as described for the sensor 21. The impact mill can thus comprise a plurality of sensors in order to perform adjustments on a plurality of impact screens.

The invention claimed is:

1. An impact mill comprising a frame (1') defining a milling chamber (1) containing a rotor (2) provided with hammers (4) uniformly arranged on its periphery, and at least one impact screen (5, 6) which, by way of its top end, is mounted pivotably on an articulation (7, 8) connected to the frame (1') of the mill, so as to be able to pivot with the aid of a respective adjusting jack (9, 10) in order to move the bottom end of the impact screen (5, 6) toward or away from the rotor (2) so as to define, between the bottom end of the impact screen and the free end of one of the hammers (4), a spacing (R) which determines a given particle size, the mill additionally comprising a device for positioning the rotor (2) that comprises indexing means (21, 22) for positioning the end of one of the hammers in a position in which it is as close as possible to the impact screen (5) for the purpose of adjusting said spacing, wherein said positioning device comprises a geared motor (11) driving a pinion (12) capable of engaging with a toothed wheel (13) arranged at one of the ends of the shaft (3) of the rotor (2) and fixed in rotation to the latter in order to rotate the rotor from a rest state to said position in which one of the hammers (4) is as close as possible to said impact screen (5).

2. The impact mill as claimed in claim 1, wherein the geared motor (11) is mounted so that it can be moved translationally between a first position in which said pinion (12) is freed from engagement with said toothed wheel (13) and a second position in which said pinion is engaged with said toothed wheel.

3. The impact mill as claimed in claim 2, wherein the geared motor (11) is moved translationally with the aid of a control jack (17).

4. The impact mill as claimed in claim 3, wherein an adjustable stop (18) is provided to regulate the translational travel of the geared motor (11) and the meshing of the pinion (12) with said toothed wheel (13).

5. The impact mill as claimed in claim 3, wherein end-of-travel detectors (19, 20) are arranged so as to detect the end positions of the translational movement of the geared motor (11).

6. The impact mill as claimed in claim 2, wherein an adjustable stop (18) is provided to regulate the translational travel of the geared motor (11) and the meshing of the pinion (12) with said toothed wheel (13).

7. The impact mill as claimed in claim 6, wherein end-of-travel detectors (19, 20) are arranged so as to detect the end positions of the translational movement of the geared motor (11).

8. The impact mill as claimed in claim 2, wherein end-of-travel detectors (19, 20) are arranged so as to detect the end positions of the translational movement of the geared motor (11).

9. The impact mill as claimed in claim 8, wherein said detectors (19, 20) are end-of-travel switches.

10. The impact mill as claimed in claim 2, wherein the geared motor (11) is fixed on a plate (14) which can be moved along a slideway (15, 16).

11. The impact mill as claimed in claim 10, wherein said slideway (15, 16) comprises guide rods (15).

12. The impact mill as claimed in claim 1, wherein said indexing means comprise locating members (22) arranged at one of the ends of the shaft of the rotor (2) and detected by a first fixed sensor (21), the number of said locating members (22) being equal to the number of hammers (4).

13. The impact mill as claimed in claim 12, wherein said sensor (21) is an induction sensor which is sensitive to the locating members (22).

14. The impact mill as claimed in claim 13, wherein the indexing means comprise a second fixed sensor (24) offset angularly with respect to the first sensor (21) in order to stop the rotation of the rotor (2) when a hammer (4) is directed substantially vertically upward.

15. The impact mill as claimed in claim 12, wherein the indexing means comprise a second fixed sensor (24) offset angularly with respect to the first sensor (21) in order to stop the rotation of the rotor (2) when a hammer (4) is directed substantially vertically upward.

16. The impact mill as claimed in claim 1, which comprises a plurality of sensors in order to perform adjustments on a plurality of impact screens.

* * * * *